United States Patent [19]

Johnson

[11] 3,968,336

[45] July 6, 1976

[54] KEYBOARD SWITCH ASSEMBLY HAVING MOVABLE CONTACT, AND SUPPORTING HELICLINE TYPE LEGS DISPOSED CO-PLANAR TO COMMON CONDUCTIVE SHEET

[75] Inventor: Wendell C. Johnson, Topanga, Calif.

[73] Assignee: Xerox Corporation, Stamford, Conn.

[22] Filed: Sept. 23, 1974

[21] Appl. No.: 508,480

[52] U.S. Cl. ..... 200/5 A; 200/67 DB; 200/159 B; 200/275; 200/292

[51] Int. Cl.[2] ..... H01H 13/26; H01H 1/06

[58] Field of Search..... 200/5 R, 5 A, 67 D–67 DB, 200/159 R, 159 A, 159 B, 275, 276, 83 B, 83 N, 243, DIG. 1, 292; 335/196

[56] References Cited

UNITED STATES PATENTS

| | | | |
|---|---|---|---|
| 3,133,170 | 5/1964 | Nanninga | 200/67 DB |
| 3,331,040 | 7/1967 | Woodhead | 335/196 X |
| 3,467,923 | 9/1969 | Woodhead | 335/196 |
| 3,571,542 | 3/1971 | Madden et al. | 200/83 N |
| 3,594,522 | 7/1971 | Colglazier et al. | 200/159 B X |
| 3,600,528 | 8/1971 | Leposavic | 200/5 A |
| 3,643,041 | 2/1972 | Jackson | 200/DIG. 1 X |
| 3,697,711 | 10/1972 | Tetrick | 200/5 A X |
| 3,742,157 | 6/1973 | Leposavic | 200/159 B X |
| 3,800,104 | 3/1974 | Lien et al. | 200/5 A |
| 3,831,118 | 8/1974 | Bitko | 335/196 X |
| 3,842,230 | 10/1974 | Kashio et al. | 200/276 |

OTHER PUBLICATIONS

IBM Technical Disclosure Bulletin, H. L. Funk et al., "Keyboard Encoder," vol. 7, No. 11, Apr. 1965, pp. 1018, 1019.

*Primary Examiner*—James R. Scott
*Attorney, Agent, or Firm*—John E. Beck; Terry J. Anderson; Leonard Zalman

[57] ABSTRACT

A switching device having a movable contact element characterized by a set of unconnected, curved slots radiating outward from a central key area and equally spaced around the central key area. The radially extending unconnected, curved slots may be sections of a spiral, at least some of which sections overlap each other. Adjustment of the spring rate of the movable contact element is accomplished by adjusting the length of the slots or by regulating the distance of the inner terminus of the slots from a central point of the central key area. The movable contact element either contacts a second contact element for contact switching or approaches the second contact element for capacitive switching.

A plurality of the switching elements can be formed in a planar array on a continuous metallic substrate to provide a keyboard. The movable switching elements can be formed on the metallized areas of a printed circuit board.

50 Claims, 17 Drawing Figures

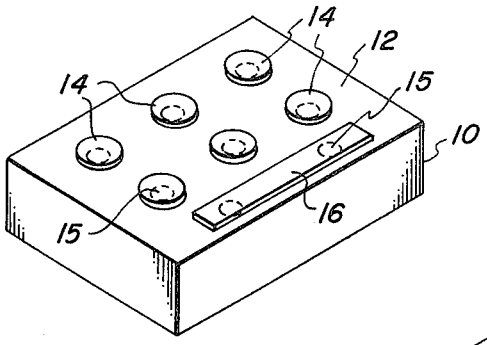
FIG. 1
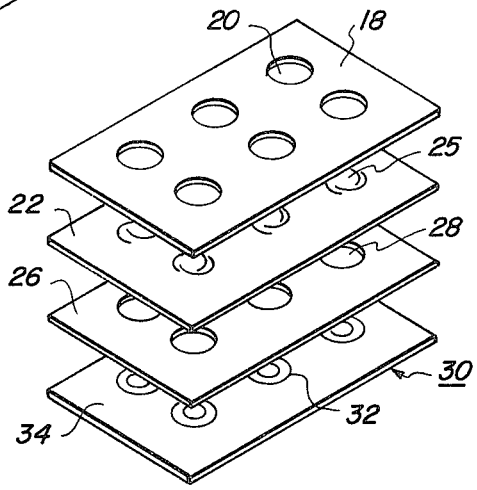
FIG. 2A
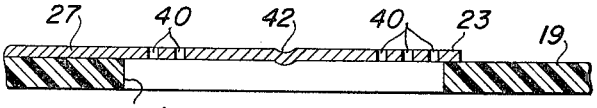
FIG. 2D
FIG. 2B
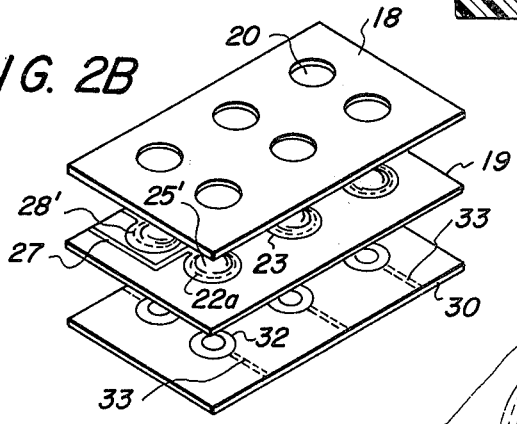
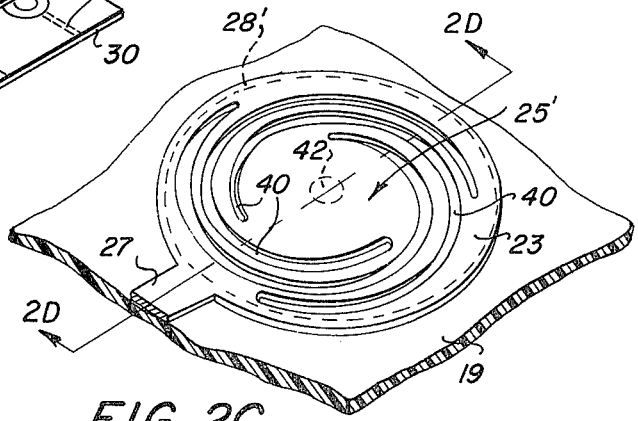
FIG. 2C

KEYBOARD SWITCH ASSEMBLY HAVING MOVABLE CONTACT, AND SUPPORTING HELICLINE TYPE LEGS DISPOSED CO-PLANAR TO COMMON CONDUCTIVE SHEET

BACKGROUND OF THE INVENTION

Heretofore, most keyboards have been formed of an array of switches comprised of a plurality of discrete components that are united to form a relatively complex electro-mechanical linkage. Normally, such switches include a plunger which, when depressed, will complete or close an electrical circuit. Generally, a discrete spring, which is compressed when the plunger is depressed, is used to return the plunger to its normal position.

Keyboards of the type having discrete components united to form an electro-mechanical linkage have not proven to be satisfactory. One reason is because of the mounting of the individual plungers, springs and leverages in close relation becomes a tedious and time-consuming task. Also, these keyboards have a questionable level of reliability due to the large number of mechanical elements required for each switch and the wear associated with these mechanical elements. Further, the cost of such keyboards is relatively high.

To overcome the problems associated with keyboards using switches having discrete components, it has been proposed to provide the switches in large, relatively flat, plate-like banks. Such a keyboard is described in U.S. Pat. No. 3,600,528, wherein a plurality of movable contact elements are formed on a sheet of tempered beryllium copper. In one described form, the movable contact elements have a solid, flat center with a plurality of spider-like fingers extending radially outward for yieldable contact with a ring-like, fixed contact element formed on a printed circuit board. Each key is defined by spacers which extend between the fixed contact and the movable contact. By this arrangement, it is alleged that when a downward pressure is applied against the solid center, the spider legs associated therewith are flexed while the center contact moves spirally perpendicular to the fixed contact elements of the printed circuit board. Thus, it is alleged that a wiping contact is made between the movable contact element and the fixed contact element therebeneath, and that this contact is achieved with a minimum of cost in both assembly and material.

The relatively flat bank of switches provided by the structure of U.S. Pat. No. 3,600,528, is not satisfactory for a number of reasons. First, the formation of the plurality of spider-like fingers of each contact element requires substantial etching or gang stamping to remove a substantially large, interconnected portion of the metallic sheet. Specifically, four sets of four spider-like legs must be etched for each movable contact element. Obviously, the formation of this keyboard is complex and expensive. Also, since only a very small portion of the metallic sheet remains as the movable contact, the contact is weakly supported and thus prone to failure when subjected to repeated depressions. Partly to overcome this weakness, the movable contact elements are supported above the circuit board by a screen of spacer elements, thus adding to cost and complexity. Additionally, the movable contacts do not provide a good wiping contact with the stationary contacts since there is believed to be only a slight rotation of the movable contact when it is depressed. Also, the keyboard is not adaptable easily to multiple-switching actions.

Other electro-mechanical switches have been formed by cutting a pattern of apertures in an electrically conductive sheet. U.S. Pat. No. 3,697,711 teaches the use of arcs of a circle to provide a flexible switch, as does U.S. Pat. No. 3,467,923. However, these switches do not provide a sufficiently yieldable movable member such as is needed for the switches of a keyboard. In U.S. Pat. No. 3,594,522, a plurality of continuous spiral conductors are used in an elastic diaphragm switch, the spiral conductors being coupled to a central support. The continuous spiral path is very flexible, being supported at only one point, and hence they would not survive the repeated depressions required of a switch utilized in a keyboard.

In some switches of the type discussed, the closing of the electrical circuit is achieved by a mechanical contact between two contact elements. In another type of switch, a metallic plate is moved toward two separated, electrically energized, stationary plates to effect a change in the capacitive coupling between each of the stationary plates and the movable plate to thereby provide a capacitive switching action. Since the two separated, electrically energized plates act with the movable plate as capacitors in series, the change in capacitive coupling is very small. Attempts have been made to use capacitive switching in which a charged electrode of the capacitor is moved toward the other charged electrode of the capacitor. While this arrangement gives a greater capacitive coupling than one using capacitors in series, attachment of a lead to a moving member in a keyboard environment has not been feasible heretofore because; for example, of the close space requirements of conventional keyboards.

OBJECTS OF THE INVENTION

It is an object of the present invention to provide an improved switching device.

It is a further object of the present invention to provide a switching device that is more reliable than prior art switching devices.

It is a still further object of the present invention to provide a planar array of improved switching devices.

It is a still further object of the present invention to overcome the aforementioned objectionable aspects in the construction and manufacture of planar keyboard switches.

It is a further object of the present invention to provide an improved keyboard arrangement that uses switches in a planar array.

It is a still further object of the present invention to provide a keyboard that is extremely simple to produce.

It is a further object of the present invention to provide a keyboard that can be produced with a minimum of cost.

SUMMARY OF THE INVENTION

In accordance with the invention, the aforementioned objects are achieved by providing a movable switching element which is integral with a surrounding metallic substrate and co-planar with the substrate when the movable switching element is in its undepressed or normal state. The switching element is characterized by a set of unconnected, curved slots or apertures radiating from a central key area of the switching element. The slots can be formed in the metallic substrate by conventional printed circuit techniques. The radially extending, unconnected curved slots can be sections of a spiral, at least some of which sections overlap each other. In a preferred form of the invention, the curved slots are involutes of a circle which are equally spaced around (each of) the central key area(s). Adjustment of the spring rate of the switch is accomplished by adjusting the length of the curved slots or by having the inner terminus of the slots extend further into the central key area. The central key area may be provided with an indentation when the movable contact is used to provide a mechanical close.

A plurality of the movable switching elements can be formed on a single metallic substrate and the substrate used as a component of a keyboard. Each of the movable switching elements would be positioned adjacent another contact to provide either a mechanical or capacitive switching action. By regulating the length of the curved slots and the location of their inner terminus, different switches of the substrate can be made to have different spring rates. The metallic substrate can be supported on a non-metallic substrate, e.g., a printed circuit board, with areas of the substrate removed to electrically isolate the movable switching elements and to provide electrical connections thereto.

A keyboard utilizing the present invention adapts itself well to multiple switching action. By providing two adjacent metallic substrates, each having similarly positioned, unconnected, curved slots radiating from central key areas, more than one switching action can be achieved by depressing one of the central key areas of the top circuit board. This is possible because of the great flex provided by the movable switches or keys of the present invention which allows them to travel a great distance before they exceed their elastic limit. The multiple closures can produce a multiple capacitive switching action, or a multiple mechanical switching action, or a combination of capacitive switching and mechanical switching. Further, where capacitive switching is used, the capacitive coupling is greater than that of prior art capacitive switches since both plates of the capacitor can easily be connected to voltage sources, the movable switching element being provided a potential through the metallic substrate. Also, with both plates of the capacitor moving once a predetermined separation therebetween is achieved, the capacitive coupling remains constant even with further movement of both of the plates.

The foregoing objects and other objects and advantages of the present invention will become apparent from a reading of the following specification in conjunction with the accompanying drawings in which:

FIG. 1 is a perspective view of a data entry device incorporating a keyboard having switches in accordance with the present invention.

FIGS. 2A and 2B are exploded views of two types of keyboards in accordance with the present invention.

FIG. 2C is an exploded, perspective view of a portion of the keyboard of FIG. 2B.

FIG. 2D is a cross-sectional view of the keyboard portion of FIG. 2C.

Figure 8:
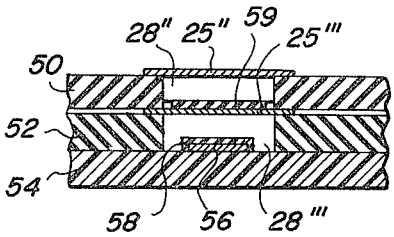
FIG. 8 is a cross-sectional view of one switching device of FIG. 7.
Figure 9A:
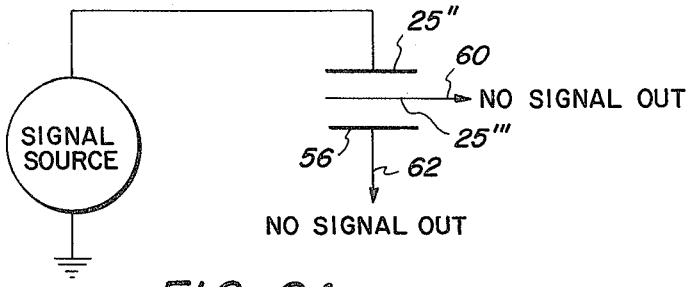

FIG. 9A, B and C show the output signals generated with the device of FIG. 8.

Figure 10:
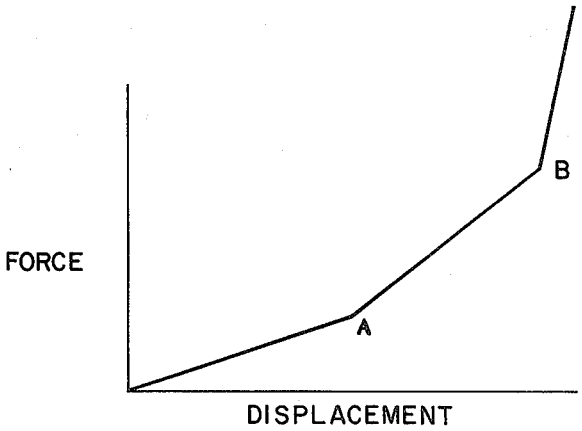

FIG. 10 shows the force-displacement curve for the device of FIG. 8.

Figure 11:
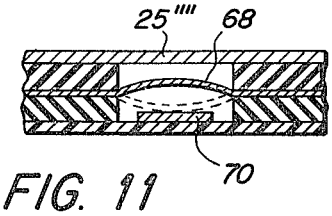

FIG. 11 is a cross-sectional view of a variation of the device of FIG. 8.

DESCRIPTION OF THE PREFERRED EMBODIMENT

With particular reference to FIG. 1, there is presented a data entry device 10, such as a typewriter, calculator, or computer terminal, in which the present invention can be incorporated. The illustrated device includes a keyboard panel 12 having a plurality of keys 14 arranged in a convenient manner to be depressed by the fingertips of an operator, thus entering the required data into the data entry device. Each key has a post 15, shown in phantom, that would contact or be disposed adjacent the movable key or switching elements to be described. The data entry device 10 may also have a spacer or margin bar which is generally indicated at 16.

Referring now to FIG. 2A, the keyboard 12 of FIG. 1 is shown in greater detail and in an exploded form. The keyboard includes an insulating plate 18 having a plurality of openings 20 therein. Mounted below plate 18 is a thin, continuous sheet of metal 22, preferably of beryllium copper, which has a plurality of movable switching elements 25 formed therein. The structure of the movable switching elements 25, and an exemplary method of their manufacture are described in detail hereinafter. Immediately below the sheet 22, and preferably in contact therewith, is provided a flat insulating plate 26, which may be formed of any conventional insulating material such as Mylar. Plate 26 has a plurality of holes 28 therein. The sheet 22 and the plate 26 may be integral, such as in a printed circuit board, with the insulating plate having the top surface metallized with a thin (0.001 inch thick) coating of metal, for example, a beryllium copper alloy. In such a case, as illustrated in FIG. 2B, the coating on the printed circuit board 19 would be etched to provide a plurality of co-planar metallized areas 23, each of which has a movable switching element 25' formed therein and a conductor 27 leading thereto which conductors are connected to leads (not shown) for maintaining the switching elements 25' at a desired potential. The insulating plate has a hole 28' shown in phantom below each of the switch elements 25'.

As shown in FIG. 2A the openings 20 and the holes 28 each register with a different one of the movable switching elements 25 of the sheet 22. Positioned beneath the insulating plate 26, and preferably in contact therewith, is a circuit or contact board 30 which may be a conventional printed circuit board. Contact buttons or rings 32 are formed, as by etching, on the insulating substrate 34 of circuit board 30 and each is positioned in registration with a hole 28, a movable switching element 25 and an opening 20. The plate 18, the metal sheet 22, the insulating plate 26, and the circuit board 30 form a "sandwich" which is extremely compact and occupies only a thin top layer of the device 10.

Figure 3A:
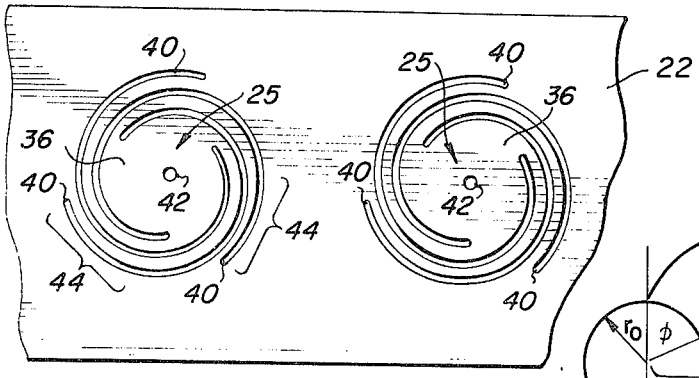
FIG. 3A is a plan view of a portion of the keyboard in FIG. 2.
Figure 3B:
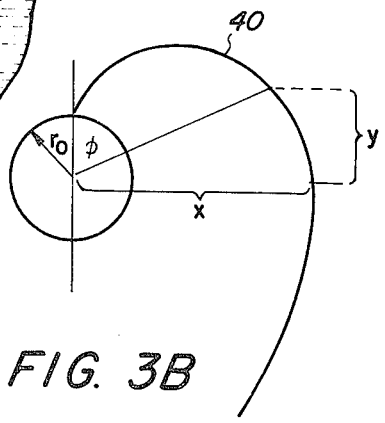
FIG. 3B is a graph exemplifying the shape of the slots of the portion of the keyboard shown in FIG. 3A.

A plane view of a portion of sheet 22 is shown in FIG. 3A. Each movable switching element or member 25 includes a central contact area 36 which is surrounded by a group of unconnected, curve slots 40. The slots 40 extend radially outward, preferably at a steadily increasing rate, from the central areas 36. The slots 40 may be in the form of a spiral and preferably originate from points that are both equally spaced about the periphery of the central areas 36 and equidistant from a central portion 42 of the central areas 36. If the movable switching elements 25 are to be used as contact switches, each of the central portions 42 may be in the form of a dimple extending downward toward the circuit board 30. Preferably, the slots 40 are involutes of a circle repeated three times at 120° intervals around the central areas 36. The involutes would have X and Y dimensions according to the formulas $X = r_0 (\sin \phi - \phi \cos \phi)$ and $Y = r_0 (\cos \phi + \phi \sin \phi)$, where $r_0$ is the distance from the central portion 42 to the beginning of each spiral and the angle $\phi$ is measured from the point where each of the spirals begins, as shown in FIG. 3B.

As shown in FIG. 3A, adjacent slots 40 are equally spaced from each other where they are adjacent. Also as shown in FIG. 3A, in a preferred embodiment of the invention each switching element 25 is defined by three slots 40 with each of the slots 40½ mm wide and each extending for about 325 rotary degrees from start to finish, which provides a structure wherein the three slots 40 defining each switching element have portions adjacent each other and equally spaced from each other over areas 44 which are equally spaced around central area 36. If desired, the inner terminus of each slot 40 can be extended inwardly or outwardly, that is, $r_0$ can be decreased or increased, or the outer terminus of each slot 40 may be extended outwardly or inwardly to provide a different spring force for the switching elements 25, that is, more or less force to move the switching element 25 a predetermined displacement distance. If desired, different of the switching elements 25 may have a different spring force. Where it is desired to have a single key member, such as bar 16, actuate several switches simultaneously to produce two switching functions and still have the key member possess the same force-displacement response as the other keys 14, the bar 16 would be supported by two posts 15, each contacting a different movable switching element 25 with the slots 40 of these movable switching elements having their inner terminus nearer to the central portions 42 such that the two switching elements responsive to depression of key 16 will permit key 16 to have a force-displacement response similar to the response of the other keys 14.

In the illustrated embodiment of FIG. 2A, sheet 22 can be of beryllium copper having a thickness of ¼ mm. As noted, the slots 40 would be ½ mm wide and may be formed by conventional printed circuit techniques, such as, for example, chemical milling. Preferably, the inner terminus of each of the slots 40 would be 4 mm from the central portion 42 of the central areas 36, although a greater distance will produce a movable member that is more rigid (less springy) than the preferred form, and a lesser distance will produce a movable member that is less rigid (more springy) than the preferred form. The distance between central portions 42 is preferably ¾ of an inch.

In an exemplary, conventional chemical milling process for forming slots 40, a chromate-gelatin or other photosensitive film is first applied to both sides of the sheet 22, which, as stated, may be a beryllium copper alloy. Next, both sides of sheet 22 are masked with a photographic negative of the slot pattern of switching elements 25, followed by exposure to radiation of a frequency, e.g., ultra-violet light, that will set or harden the photosensitive film in those areas exposed to the radiation. Care must be taken that the pattern that is projected on one side of sheet 22 is in registration with the pattern projected on the other side of sheet 22. Then, the non-exposed parts of the film are dissolved, for example, with alcohol or methanol. Subsequently, the parts of the beryllium copper layer not protected by film are etched away from both sides by means of an acid, such as, for example, nitric acid to produce slots 40. Following this, the remainder of the hardened protective film is removed by a suitable solvent. Instead of the chemical milling process described, the slot pattern may be formed by stencil etching, for example, silk screening, whereby any lacquer or enamel may be used to make up a protective film, followed by etching of the beryllium copper sheet. The etching of the beryllium copper sheet to form the desired slot pattern also can be achieved by etching through from only one side of the beryllium copper sheet.

Figure 4:
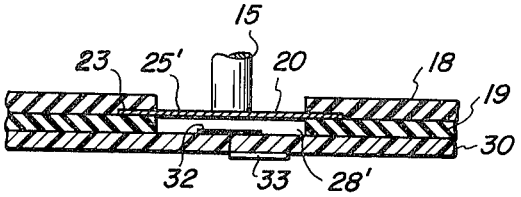
FIG. 4 is a cross-sectional view of one of the switches of the keyboard of FIG. 3B when in its normal position.
Figure 5:
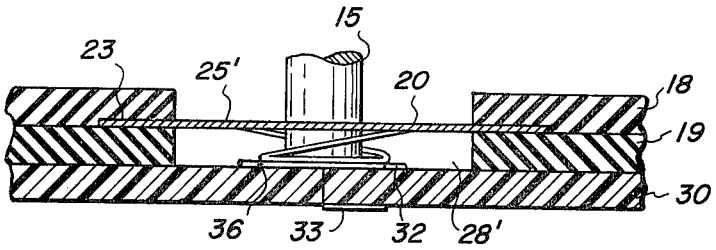
FIG. 5 is a cross-sectional view of the switch of FIG. 4 when depressed.

The operation of the keyboard of the present invention may best be described by reference to FIGS. 4, 5 and 6 which show a cross-section of one of the switches of FIG. 2B formed by movable switching element 25' and stationary contact 32. It may be seen in FIG. 4 that there is no electrical contact between the central portion 36 of movable contact element 25' and the contact 32. When the central area 36 is depressed, by the action of post 15 being pushed downward due to a force applied to the key 14 associated with that post, the central portion 36 moves downward toward conductor 32 while simultaneously rotating. This downward movement and rotation are achieved due to the "spring action" allowed by slots 40. When the central portion 36 is depressed, the spiral slots 40 are twisted to form involutions approximating a loxodomical helix in the depressed state, as shown in FIG. 5. The orientation of slots 40 producing the loxodomical helix provide a significant rotation of the central portion 36 and produce an effective wiping contact between portion 36 and contact 32 when they meet, as shown in FIG. 5. Thus, when portion 36 and contact 32 meet, an electrical circuit is closed through leads 33 and 27, shown in FIG. 2B, to energize approximate circuitry.

Figure 6:
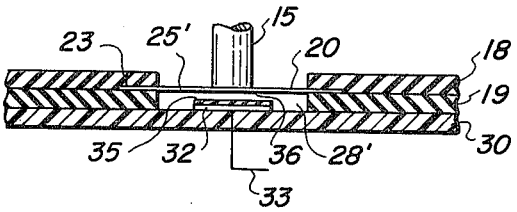
FIG. 6 is a cross-sectional view of a capacitive switch according to the invention.

When capacitive switching is utilized, a thin insulating pad 35, as shown in FIG. 6, covers the contact 32. When the switching element 25' is depressed, the capacitance existing between central portion 36 and contact 32 is substantially greater than when switching element 25' is in its normal position. Therefore, a circuit connected between the switching element 25' and the contact 32 will have a variable capacitance depending on the position of portion 36 and contact 32. Conventional capacitive change sensing circuitry may be utilized to detect this change in capacitance to provide a switching action.

Figure 7:
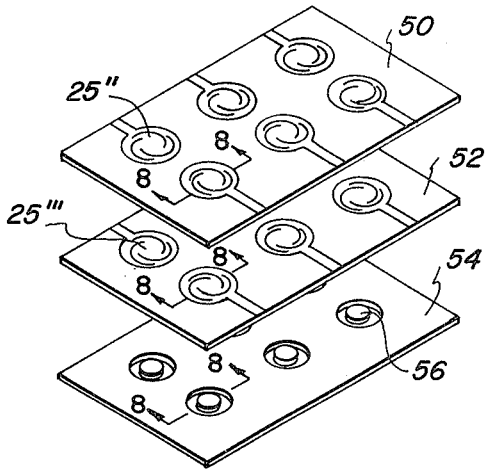
FIG. 7 is an exploded view of a keyboard for multiple switching in accordance with the present invention.
Figure 9B:
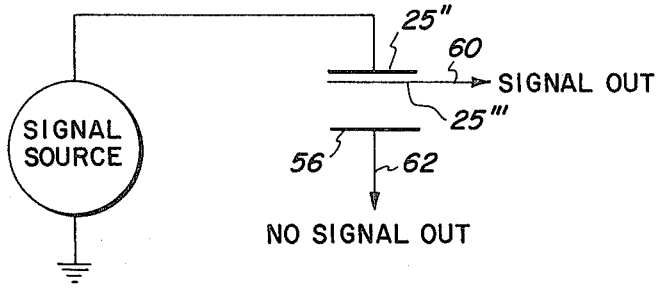
Figure 9C:
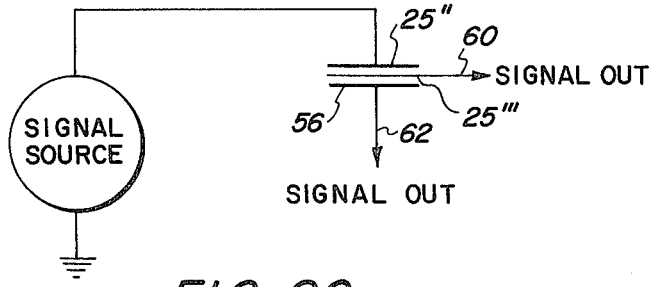

As shown in FIGS. 7 and 8, two circuit boards 50 and 52 like circuit board 19 of FIG. 2B may be mounted adjacent each other along with a printed circuit board 54 having contacts 56 in registration with both the movable switching elements 25'' and 25''' of circuit boards 50 and 52, respectively. Switching elements 25'' and 25''' may be identical to switching elements 25 and, preferably, the boards 50, 52 and 54 are sandwiched together. As shown in FIG. 8, which is a cross-section view taken of one set of switches of the device of FIG. 7, the insulating substrate of circuit boards 50 and 52 have apertures 28'' and 28''', respectively, beneath the movable spring contact 25'' and 25''', respectively, thereof. When used for capacitive switching, thin insulator layers 58 and 59 cover contact 56 and movable switching member 25''', respectively. With this structure shown in FIGS. 7 and 8, two switching actions can be achieved, as illustrated in FIG. 9 which shows an electrical analog of the device of FIGS. 7 and 8, that is, two capacitors in series. Electrical leads (not shown) supply a signal to switching element 25'' and convey output signals from element 25''' and contact 56. In the position when neither switching element 25'' nor 25''' is depressed, the leads 60 and 62 have no output, that is, the capacitive coupling between them is small and they act as open switches, as shown in FIG. 9A. When the movable member 25'' is depressed, the capacitive coupling between elements 25' and 25''' increases such that sensing circuitry will indicate an output signal on lead 60, but still no output signal on lead 62, as depicted in FIG. 9B. When movable switching element 25'' is further depressed, it also now moves member 25''' from which it is isolated by layer 59. Now the capacitive coupling between element 25''' and contact 56 increases to generate a second output signal on line 62, as shown in FIG. 9C. Note that the first signal produced by the downward movement of element 25'' does not change in amplitude once element 25'' hits the insulator layer 59 above element 25''', movable elements 25'' and 25''' move as a pair but retain the spacing therebetween once element 25'' contacts layer 59. Thus, the output signal on lead 60 does not change in amplitude once element 25''' begins to move downward. Obviously, for contact switching insulating layers 58 and 59 would not be used.

FIG. 10 shows the force-displacement curve of the switching devices of FIG. 7. As shown, the force-displacement curve increases linearly at a first rate until the switching element 25'' hits the layer 59 (point A), at which time the force-displacement curve increases at a second, steeper rate due to the combined resistance of series contact elements 25'' and 25''' which act as springs in parallel until the element 25''' contacts layer 58. After the latter contact (point B), additional force will not produce additional displacement.

Multiple switching can be achieved by using one spring member of the type shown in FIG. 3A and another type of spring member, such as a dome-shaped resilient deformable dimple as taught by U.S. Pat. No. 3,643,041 and as shown in FIG. 11. When the switching element 25'''' reaches the snap contact 68, one output signal is generated. The snap or dimple 68 will resist downward movement until a certain predetermined force is exerted thereon whereupon the dimple collapses with a snap action, resulting in the convex portion of the dimple becoming concave (shown dotted) and contacting the contact button 70. For capacitive switching and contact switching a thin insulator would cover the top of button 70.

It can thus be seen that the switch of the present invention utilizes a planar structure and can be produced with a minimum of metal removal. Also, the spring-type contact produced is strong and can withstand repeated depressions. In addition, the planar structure lends itself well to multi-switching actions. Further, the rotating movement of the switching elements 25, due to the spiral slots 40, provides a significant wiping action with a contact plate when the switch is used as a contact switch with the resulting positive signalling action due to the twisting of the protruding dimple into the contact plate.

In addition to the foregoing advantages, the switch of the present invention provides a satisfactory mechanical sensor feedback signal through the fingertips of the operator while requiring minimum key travel for single or multiple switching functions. The rotary motion of the movable switch results in contact cleaning, thus assuring excellent electrical properties during the switching function. While only three radially extending slots are shown, more or less slots can be used depending upon the force-displacement characteristics that are desired and the center-to-center spacing between the switching elements when the switching elements are used in a keyboard type device.

When used in a keyboard, a plurality of planar switching elements can be provided with a minimum of cost and assembly problems. The keyboard, even when used in a multi-switching mode, would require only little space, providing a relatively flat input device. Pressure preloading of the keys of a keyboard may be achieved by having the key post contact the switching elements 25 or displace them slightly downward.

What I claim is:

1. A switching device comprising:

a first electrically conductive contact member having a plurality of unconnected, curved slots radiating substantially continuously outward from a common portion thereof, a second electrically conductive contact member having at least a portion thereof positioned in axial alignment with at least a portion of said common portion of said first contact member, and means for normally separating said first and second contact members but permitting at least said common portion of said first contact member to move toward said aligned portion of said second contact member when a force is applied to said common portion of said first contact member to thereby effect a switching action.

2. The switching device of claim 1 wherein said slots are of equal length.

3. The switching device of claim 1 wherein said slots are sections of a spiral.

4. The switching device of claim 1 wherein said slots have a smooth curve.

5. The switching device of claim 1 wherein each slot is inwardly of the other slots over one portion thereof, outward of the other slots over a second portion thereof, and intermediate the other slots over a third portion thereof.

6. The switching device of claim 1 wherein said common portion touches said second contact member when said force is applied to effect a contact switching action.

7. The switching device of claim 1 wherein a stationary electrically insulating layer is disposed between said common portion and said second contact member such switching action is a capacitive switching action.

8. A switching device comprising:

a first electrically conductive member having at least three curved, unconnected, outwardly radiating slots therein which define a common portion thereof, said at least three slots each having portions which are radially adjacent portions of the other of said at least three slots, a second electrically conductive contact member having at least a portion thereof positioned in axial alignment with at least a portion of said common portion of said first contact member, and means for normally separating said first and second contact members but permitting at least said common portion of said first contact member to move toward said aligned portion of said second contact member when a force is applied to said common portion of said first contact member to thereby effect a switching action.

9. The switching device of claim 8 wherein said slots are sections of a spiral.

10. The switching device of claim 8 wherein said slots are of equal length.

11. The switching device of claim 8 wherein said slots have a smooth curve.

12. The switching device of claim 8 wherein substantially only the inner end of each of said slots lies on the circumference of a first circle and substantially only the outer end of each of said slots lies on the circumference of a second circle, said circles being concentric.

13. The switching device of claim 8 wherein substantially only the inner end of each of said slots lies on the circumference of a circle.

14. A keyboard switching device comprising:

a first electrically conductive member having a plurality of planar spring-like patterns formed on separate conductive surfaces thereof, each of said patterns comprising a plurality of unconnected, curved slots radiating continuously outwardly from a common portion thereof, a plurality of conductive members, at least some of said plurality of conductive members being positioned adjacent at least some different ones of said common portions; and electrically insulating means for normally separating said adjacent center portions and contact members but permitting each one of said adjacent common portions to effect a switching action when said one common portion is forced from the plane of said first member.

15. A switching device comprising:

a first electrically conductive contact member having a plurality of unconnected, curved slots radiating outwardly from a common portion thereof, each of said slots being inwardly of at least portions of at least two other of said slots over one portion of its length, outward of at least portions of at least two other of said slots over a second portion of its length, and intermediate at least portions of at least two other of said slots over a third portion of its length, a second electrically conductive contact member having at least a portion thereof positioned in axial alignment with at least a portion of said common portion of said first contact member, and means for normally separating said first and second contact members but permitting at least said common portion of said first contact member to move toward said aligned portion of said second contact member when a force is applied to said common portion of said first contact member to thereby effect a switching action.

16. A switching device comprising:

an insulating member having a metallic coating over at least a portion of a surface thereof, said coating including a plurality of curved metallic strips which define a movable area of said coating, said strips extending substantially continuously outwardly from said movable area toward a peripheral area of said coating, and an electrically conductive contact member having at least a portion thereof in axial alignment with at least a portion of said movable area of said coating, said insulating member having an aperture therein adjacent to said movable area of said coating such that said movable area can be moved through at least a portion of said aperture toward said contact member when a force is applied to said movable area of said coating to thereby effect a switching action.

17. A keyboard for effecting an electrical change upon depression of keys by an operator, comprising:

a plurality of conductive surfaces supported in a common plane by electrically insulating support means, each of said surfaces having a plurality of unconnected, curved slots radiating continuously outward from a common portion thereof;

a contact board positioned adjacent said support means and having a plurality of electrical contacts, at least some of said plurality of contacts in axial alignment with different ones of said common portions;

said electrical insulating support means normally separating said axially aligned electrical contacts from said common portions but permitting each of said common portions to be forcibly moved toward said electrical contact in axial alignment therewith to effect a switching action.

18. A switching device comprising:

an electrically insulating planar substrate having a metallic coating over at least a portion of a surface thereof, said coating having a plurality of unconnected, curved slots radiating substantially continuously outward from a common portion of said coating, and an electrically conductive contact member having at least a portion thereof positioned in axial alignment with at least a portion of said common portion of said coating, said insulating substrate having an aperture therein adjacent to said common portion of said coating such that at least said common portion of said coating can be moved through at least a portion of said aperture toward said contact member when a force is applied to said common portion of said coating to thereby effect a switching action.

19. The switching device of claim 18 wherein said slots are sections of a spiral.

20. The switching device of claim 18 wherein said slots are of equal length.

21. The switching device of claim 18 wherein said slots have a smooth curve.

22. The switching device of claim 18 wherein each of said slots is inwardly of at least two other of said slots over one portion of its length and outwardly of at least two other of said slots over another portion of its length.

23. The switching device of claim 18 wherein each of said slots has at least a portion which is radially adjacent at least two other of said slots.

24. The switching device of claim 18 wherein said common portion touches said second contact member when said force is applied to effect a contact switching action.

25. The switching device of claim 18 wherein said second contact member has an electrically insulating layer on the surface thereof facing said common portion such that said switching action is a capacitive switching action.

26. A switching device comprising:

an electrically insulating support substrate having a metallic coating over at least a portion of a surface thereof, said coating having therein at least three slots radiating outwardly from a common portion thereof, the inner ends of said slots defining an equilateral geometric shape and each of said slots extending over an angle of a magnitude such that each of said slots is inwardly of at least a portion of at least two other of said slots over one portion of its length and outwardly of at least a portion of at least two other of said slots over another portion of its length, and an electrically conductive contact member having at least a portion thereof in axial alignment with at least a portion of said common portion of said coating, said insulating substrate having an aperture therein adjacent to said common portion of said coating such that at least said common portion can be moved through at least a portion of said aperture toward said contact member when a force is applied to said common portion of said coating to thereby effect a switching action.

27. The switching device of claim 26 wherein said slots are of equal length.

28. The switching device of claim 26 wherein said slots have a smooth curve.

29. The switching device of claim 26 wherein substantially only the inner end of each of said slots lies on the circumference of a circle.

30. The switching device of claim 26 wherein lines joining the inner ends of said slots define an equilateral geometric shape.

31. A keyboard switching device for effecting electrical change upon the depression of a key comprising:

a plurality of key actuating means, a first substantially planar electrically conductive member having formed therein a first plurality of switching contact members, at least some of said switching members including a group of unconnected, curved slots radiating substantially continuously outwardly from a common portion thereof, a second plurality of switching contact members, at least one of said second plurality of switching members having at least a portion thereof positioned in operative alignment with at least a portion of one of said plurality of key actuating means and at least a portion of said common portion of one of said first plurality of switching members, and means for normally separating said first conductive member from said second plurality of switching members but permitting at least said common portion of said one of said first plurality of switching members to move toward said aligned portion of said one of said second plurality of switching members when a force is applied to said one of said plurality of key actuating means to thereby effect a switching action.

32. The switching device of claim 31 wherein said slots are sections of a spiral.

33. The switching device of claim 31 wherein said slots of a group are of equal length.

34. The switching device of claim 31 wherein said slots have a smooth curve.

35. The switching device of claim 31 wherein each of said slots of a group is inwardly of at least two other of said slots of said group over one portion of its length and outwardly of at least two other of said slots of said group over another portion of its length.

36. The switching device of claim 31 wherein substantially only the inner end of each of said slots of a group lies on the circumference of a first circle and substantially only the outer end of each of said slots of a group lies on the circumference of a second circle, said circles being concentric.

37. The switching device of claim 31 wherein substantially only the inner end of each of said slots of a group lies on the circumference of a circle.

38. The switching device of claim 31 wherein lines joining the inner ends of said slots of a group define an equilateral geometric shape.

39. The switching device of claim 31 wherein each of said slots of a group has at least a portion which is radially adjacent at least two other of said slots of said group.

40. The switching device of claim 31 wherein said slots radiate substantially continuously outward.

41. A keyboard switching device for effecting a switching action when a key is depressed comprising:

a plurality of switch actuating means, a first electrically conductive member having a first plurality of movable switching contacts formed therein, each of said contacts comprised of a group of unconnected, curved slots radiating outwardly from a common portion thereof, each of said slots being inwardly of at least portions of at least two other of said slots over one portion of its length, outward of at least portions of at least two other of said slots over a second portion of its length, and intermediate at least portions of at least two other of said slots over a third portion of its length, a second plurality of contacts, at least one of said second plurality of contacts having at least a portion thereof positioned in operative alignment with both the common portion of one of said first plurality of contacts and one of said plurality of switch actuating means, and means for normally separating said first and second pluralities of contacts but permitting at least said common portion of said one of said first plurality of contacts to move toward said aligned portion of said one of said second plurality of contacts when a force is applied to said one of said switch actuating means to thereby effect a switching action by effecting a movement of said common portion of said one of said first plurality of contacts toward said one of said second plurality of contacts.

42. A keyboard switching device for effecting a switching action when a key is depressed comprising:

a plurality of key actuating means, an electrically insulating planar substrate having a plurality of discrete metallic coatings on a surface thereof, at least some of said coatings having a group of unconnected, curved slots radiating outward from a common portion thereof, and a plurality of electrically conductive contact members, at least one of said contact members having at least a portion thereof positioned in operative alignment with the common portion of at least one of said plurality of metallic coatings and with at least one of said switch actuating means, said insulating substrate having an aperture therein adjacent to said central portions of said one of said plurality of coatings such that said common portion can be moved through at least a portion of said aperture toward said one of said plurality of contact members when a force is applied to said one of said switch actuating means to thereby effect a switching action.

43. The switching device of claim 42 wherein said slots radiate substantially continuously outward.

44. A keyboard switching device for effecting a switching action when a key is depressed comprising:

an electrically insulating substrate having a plurality of apertures therein, a plurality of discrete metallic coatings supported by said substrate, at least one of said coatings having a forcibly movable portion axially aligned with one of said apertures, said movable portion defined by a group of unconnected, curved slots radiating outward from said movable portion, a plurality of fixed contact members at least a portion of one of which is along said alignment axis, and a plurality of switch actuating means, one of said plurality of switch actuating means being positioned such that said forcibly movable portion of said one of said coatings can be forced by said one switch actuating means toward said portion of said one of said plurality of contact members to thereby effect a switching action.

45. The switching device of claim 44 wherein said slots are sections of a spiral.

46. The switching device of claim 44 wherein said slots have a smooth curve.

47. The switching device of claim 44 wherein said slots radiate substantially continuously outward.

48. A switching device comprising:

a switch actuating means, a first electrically conductive contact member having a plurality of unconnected, curved slots radiating substantially continuously outwardly from a common portion thereof, a second electrically conductive contact member having at least a portion thereof positioned in axial alignment with at least a portion of said common portion of said first contact member, and means for normally separating said first and second contact members but permitting at least said common portion of said first contact member to move toward said aligned portion of said second contact member when a force is applied to said switch actuating means to thereby effect a switching action.

49. A switching device comprising:

a switch actuating means, a first electrically conductive contact member having at least three curved, unconnected, outwardly radiating slots therein which define a common portion thereof, said at least three slots each having portions which are radially adjacent portions of the other of said at least three slots, a second electrically conductive contact member having at least a portion thereof positioned in axial alignment with at least a portion of said common portion of said first contact member, and means for normally separating said first and second contact members but permitting at least said common portion of said first contact member to move toward said aligned portion of said second contact member when a force is applied to said switch actuating means to thereby effect a switching action.

50. A switching device comprising:

a switch actuating means, an electrically insulating planar substrate having a metallic coating over at least a portion of a surface thereof, said coating having a plurality of unconnected, curved slots radiating outward from a common portion of said coating, and an electrically conductive contact member having at least a portion thereof positioned in axial alignment with at least a portion of said common portion of said coating, said insulating substrate having an aperture therein adjacent to said common portion of said coating such that at least said common portion of said coating can be moved through at least a portion of said aperture toward said contact member when a force is applied to said switch actuating means to thereby effect a switching action.

* * * * *

UNITED STATES PATENT AND TRADEMARK OFFICE

CERTIFICATE OF CORRECTION

PATENT NO. : 3,968,336

DATED : July 6, 1976

INVENTOR(S) : Wendell C. Johnson

It is certified that error appears in the above-identified patent and that said Letters Patent are hereby corrected as shown below:

Change title to "Keyboard Switch Assembly With Improved Movable Contact".

Claim 7, line 3, after "such" insert --that--.

Claim 42, line 16, change "portions" to --portion--.

Signed and Sealed this

Thirtieth Day of November 1976

[SEAL]

*Attest:*

RUTH C. MASON
*Attesting Officer*

C. MARSHALL DANN
*Commissioner of Patents and Trademarks*